US005615521A

United States Patent [19]

Simerka

[11] Patent Number: 5,615,521

[45] Date of Patent: Apr. 1, 1997

[54] TENT FLOORING SYSTEM

[76] Inventor: Richard A. Simerka, 3908 Sycamore La., Parker, Tex. 75002-5900

[21] Appl. No.: 597,611

[22] Filed: Feb. 6, 1996

[51] Int. Cl.[6] ..... E04G 11/04

[52] U.S. Cl. ..... 52/2.22; 52/2.23; 135/116

[58] Field of Search ..... 135/137, 134, 135/148, 149, 116; 52/2.11, 2.22, 2.23, 2.24

[56] References Cited

U.S. PATENT DOCUMENTS

| | | | |
|---|---|---|---|
| D. 353,967 | 1/1995 | Moore | D6/604 |
| 2,731,055 | 1/1956 | Smith | 52/2.24 |
| 2,830,606 | 4/1958 | Daugherty | 52/2.24 X |
| 2,875,771 | 3/1959 | Brewin | 52/2.11 |
| 4,265,261 | 5/1981 | Barker | 135/116 X |
| 4,369,591 | 1/1983 | Vicino | 52/2.24 X |
| 4,590,956 | 5/1986 | Griesenbeck | 135/116 |
| 4,766,918 | 8/1988 | Odekirk | 52/2.23 |
| 4,835,800 | 6/1989 | Johnson | 5/420 |
| 4,860,395 | 8/1989 | Smith | 5/420 |
| 4,926,893 | 5/1990 | Klopfenstein et al. | 135/116 X |
| 5,007,212 | 4/1991 | Fritts et al. | 135/116 X |
| 5,078,096 | 1/1992 | Bishop et al. | 135/116 X |
| 5,217,034 | 6/1993 | Yih et al. | 135/90 |
| 5,487,400 | 1/1996 | Dawkins | 52/2.11 X |

FOREIGN PATENT DOCUMENTS

| | | | |
|---|---|---|---|
| 0593653 | 12/1977 | Switzerland | 52/2.22 |
| 8203001 | 9/1982 | WIPO | 52/2.22 |

*Primary Examiner*—Lanna Mai
*Attorney, Agent, or Firm*—Joseph N. Breaux

[57] ABSTRACT

A tent flooring system including a support structure having two separately inflatable bladder members; and a fastener assembly for securing the support structure beneath a tent. The first bladder member is provided with a non-slip surface for contact with the existing tent floor. The second bladder member has a plurality of multi-directional channeling structure protrusions extending therefrom for allowing water to pass under the first bladder member during a rainstorm or the like.

20 Claims, 2 Drawing Sheets

TENT FLOORING SYSTEM

DESCRIPTION

1. Technical Field

The present invention relates to flooring structures for portable shelters and more particularly to an inflatable floor structure for a portable shelter such as a tent.

2. Background Art

It is often desirable when erecting a tent or other portable sleeping shelter to provide an insulating and/or cushioning structure between the inhabitants and the underlying ground surface. These cushioning structures conventionally take the form of inflatable air filled mattresses upon which a sleeping bag or other form of sleeping covers is disposed. Although the use of such air mattresses accomplish the tasks of insulating and cushioning the user from contact with the underlying ground surface, it does nothing to prevent the underlying floor surface of the tent from becoming soaked during a rain storm or rain water runoff. It would be a benefit, therefore, to have an inflatable flooring structure that is positionable between the ground surface and the floor of the tent to raise the floor material of the tent above the ground surface a distance sufficient to prevent the tent floor from becoming saturated during a rain storm or the like. It would be a further benefit if the floor structure had inflatable multi-directional channeling structures that allowed water draining down an incline to freely pass beneath the flooring structure without regard to the direction of runoff. It would also be a benefit, in order to provide a comfortable flooring structure, to have an inflatable flooring structure that had separate inflation chambers for the cushioning portion of the flooring structure and the multi-directional channeling structures.

GENERAL SUMMARY DISCUSSION OF INVENTION

It is thus an object of the invention to provide a tent flooring system that includes an inflatable structure that is positionable between the ground surface and the floor of a tent to raise the floor material of the tent above the ground surface.

It is a further object of the invention to provide a tent flooring system that includes inflatable multi-directional channeling structures that allow water draining down an incline to freely pass beneath the flooring structure without regard to the direction of runoff.

It is a still further object of the invention to provide a tent flooring system that has an inflatable flooring structure that has separate inflation chambers for a cushioning portion of the flooring structure and a multi-directional channeling structure portion.

It is a still further object of the invention to provide a tent flooring system that accomplishes all or some of the above objects in combination.

Accordingly, a tent flooring system is provided. The flooring system includes a support structure including: a first inflatable bladder member having a first inflatable chamber formed therein constructed from a resilient air impermeable material and including a first inflation valve assembly in gaseous communication between the first inflatable chamber and the exterior of the first bladder member in a manner to allow a user to selectively introduce and capture air within the first inflatable chamber, and a first gripping surface coating deposited on at least a section of the exterior surface portion of the first bladder member; and a second inflatable bladder member having a second inflatable chamber formed therein constructed from a resilient, air impermeable material and including a second inflation valve assembly in gaseous communication between the second inflatable chamber and the exterior of the second bladder member in a manner to allow a user to selectively introduce and capture air within the second inflatable chamber, the second bladder member having at least twenty inflatable multi-directional channeling structure protrusions extending a substantially equal distance of at least one inch from a second outwardly directed surface thereof; the first and second bladder members being permanently secured together in a manner such that the section of the exterior surface portion of the first bladder member having the first gripping surface coating deposited thereon is positioned on an opposite side of the support structure from the at least twenty inflatable multi-directional channeling structure protrusions extending from the second outwardly directed surface of the second bladder member; and a plurality of tent attachment mechanisms in connection with the support structure and securable to a tent in a manner such that a floor member provided in the tent is positioned over the section of the exterior surface portion of the first bladder member having the first gripping surface coating deposited thereon. The first and second bladder members preferably share at least one common wall.

BRIEF DESCRIPTION OF DRAWINGS

For a further understanding of the nature and objects of the present invention, reference should be had to the following detailed description, taken in conjunction with the accompanying drawings, in which like elements are given the same or analogous reference numbers and wherein.

EXEMPLARY MODE FOR CARRYING OUT THE INVENTION

Figure 1:
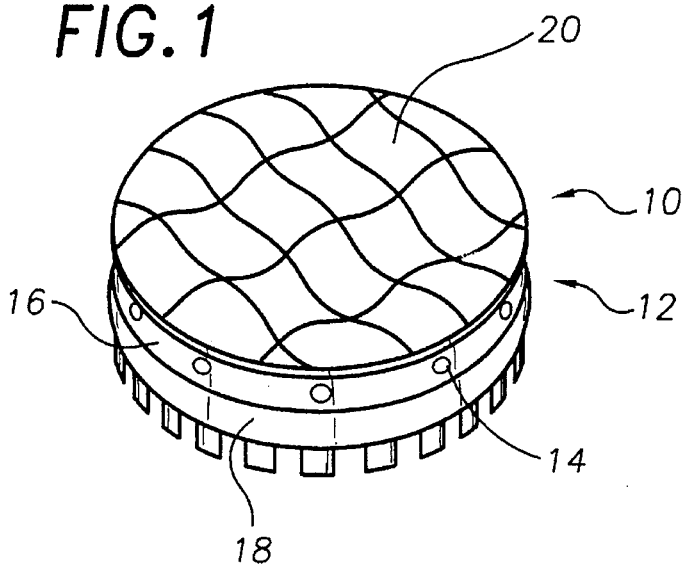
FIG. 1 is a perspective view of an exemplary embodiment of the tent flooring system of the present invention with the first gripping surface coating directed upwardly.

FIG. 1 shows the tent flooring system of the present invention generally designated by the numeral 10. Flooring system 10 includes a support structure, generally referenced by the numeral 12, and twelve tent attachment mechanisms in the form of snap fastener assemblies 14. Support structure 12 is formed from a gas impermeable, vinyl material and includes a first bladder member 16 and a second bladder member 18. The outwardly facing surface 20 of first bladder member 16 is a rayon flocking material that functions as a gripping surface when in contact with the fabric bottom surface of a tent. In this embodiment, the male portions of snap assemblies 14 are adhesively secured around the perimeter of outwardly facing surface 20. The female portions of fastener assemblies 14 are provided along with the flooring system. Before use, the female portions are secured by the user along the perimeter flaps of the tent at locations corresponding to the male portions on support structure 12. During use, snap assemblies 14 secure the flooring system 10 securely beneath the tent.

Figure 2:
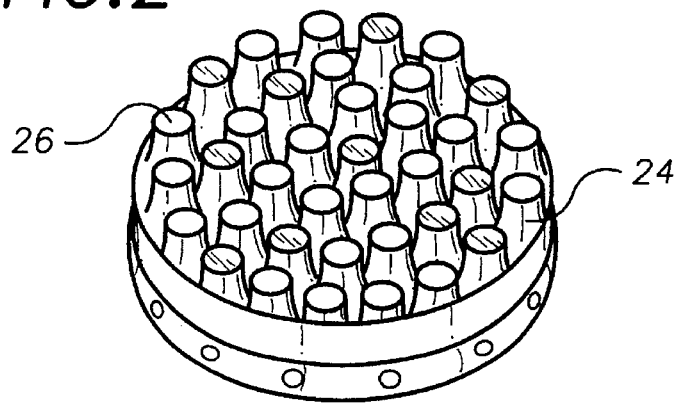
FIG. 2 is a perspective view of the tent flooring system of FIG. 1 showing the inflatable multi-directional channeling structure protrusions extending from the second outwardly directed surface of the second bladder member.

With reference to FIG. 2, the downwardly facing surface 24 of second bladder member 18 has sixty-seven outwardly projecting inflatable multi-directional channeling structure protrusions 26 extending therefrom. Each protrusion 26 is substantially cylindrical in shape and about one and one-half (1½") inches in length. A gap of about one-half (½") inch is provided between each of the protrusions to allow water to pass easily between the protrusions in any direction.

Figure 3:
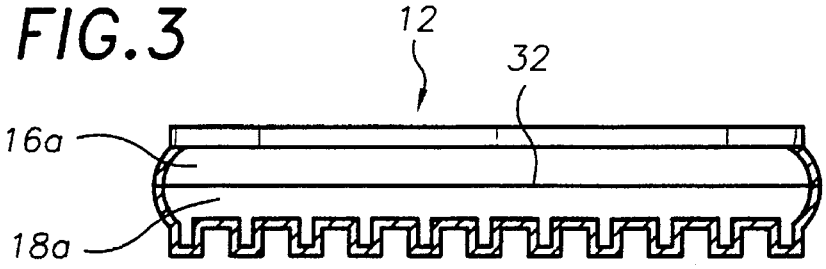
FIG. 3 is a side view of the tent flooring system showing the first and second valve mechanisms.
Figure 3A:
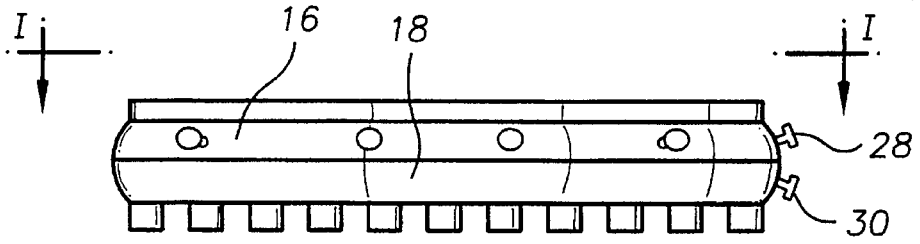
FIG. 3A is a crossectional view of the tent flooring system of FIG. 3 along the line I—I.

AS shown in FIG. 3, each bladder member 16,18 has a valve mechanism 28,30, respectively. The valve mechanisms 28,30 are identical and are the conventional one-way, duck-bill valves with insertable plugs commonly utilized in conventional air mattresses. The use of dual air bladders 16,18 allows the user to firmly inflate second air bladder 18 to provide a firm base foundation to support the tent bottom above the ground surface and to provide the flow channels between protrusions 26. First air bladder 16 functions as a conventional air mattress and is inflated according to the desired level of support desired by the tent occupants. As shown in FIG. 3A, first and second bladder members 16,18 share a common wall 32 between a first inflatable chamber **16*a* and a second inflatable chamber 18*a* to achieve an efficient use of materials and reduce the weight of support structure 12. It is contemplated by the inventor hereof to use completely separate wall members and secure first bladder member 16** to second bladder member through the use of sonic welding or other conventional method of forming the attachment.

Figure 4:
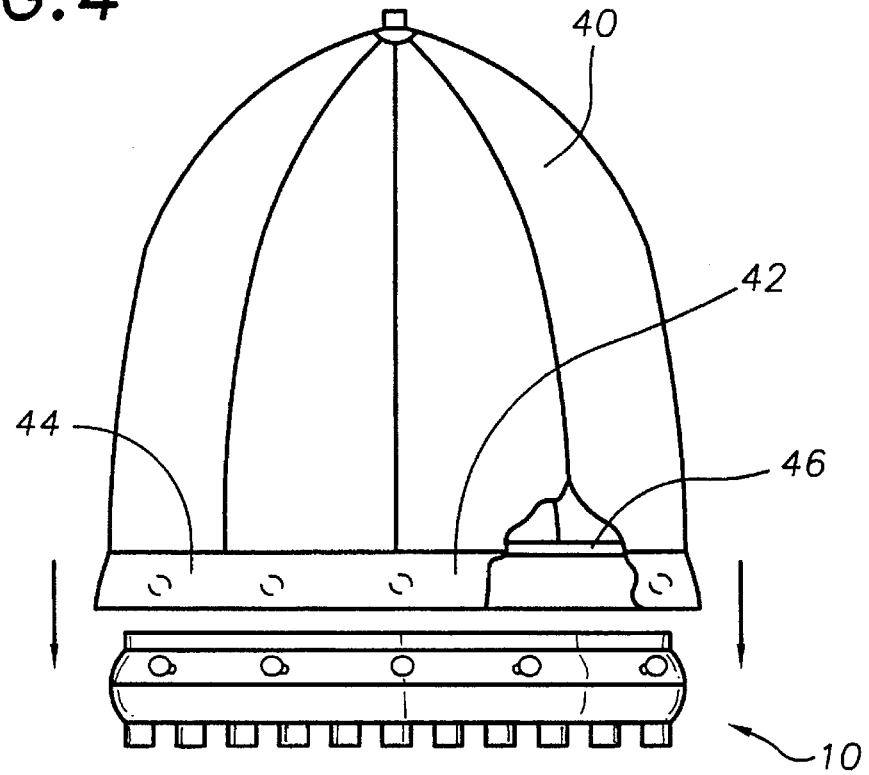
FIG. 4 is a side view of the tent flooring system with a representative tent of the type with which the flooring system is utilized.
Figure 5:
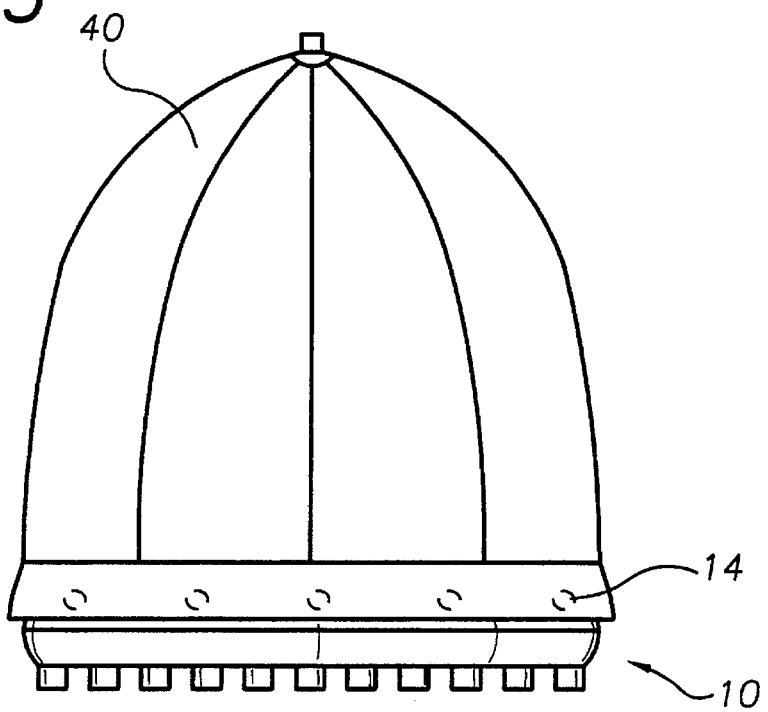
FIG. 5 is a side view of the tent flooring system secured to the representative tent with snap fasteners.

FIG. 4 is a side view of a representative tent 40 having the female portions 42 of snap fastener assemblies 14 secured around the perimeter flap 44 thereof. Representative tent 40 has a tent floor 46 permanently secured to the sidewalls. With reference to FIG. 5, tent 40 is secured to flooring system 10 by placing tent floor 46 (FIG. 4) onto outwardly facing surface 20 of first bladder member 16 and then fastening snap fastener assemblies 14.

It can be seen from the preceding description that a tent flooring system has been provided that includes an inflatable structure that is positionable between the ground surface and the floor of a tent to raise the floor material of the tent above the ground surface; that includes inflatable multi-directional channeling structures that allow water draining down an incline to freely pass beneath the flooring structure without regard to the direction of runoff; and that has an inflatable flooring structure that has separate inflation chambers for a cushioning portion of the flooring structure and a multi-directional channeling structure portion.

It is noted that the embodiment of the tent flooring system described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A tent flooring system comprising:

a support structure including:

a first inflatable bladder member having a first inflatable chamber formed therein constructed from a resilient air impermeable material and including a first inflation valve assembly in gaseous communication between said first inflatable chamber and said exterior of said first bladder member in a manner to allow a user to selectively introduce and capture air within said first inflatable chamber, and a first gripping surface coating deposited on at lease a section of said exterior surface portion of said first bladder member; and a second inflatable bladder member having a second inflatable chamber formed therein constructed from a resilient, air impermeable material and including a second inflation valve assembly in gaseous communication between said second inflatable chamber and said exterior of said second bladder member in a manner to allow a user to selectively introduce and capture air within said second inflatable chamber, said second bladder member having at least twenty inflatable multi-directional channeling structure protrusions extending a substantially equal distance of at least one inch from a second outwardly directed surface thereof; said first and second bladder members being permanently secured together in a manner such that said section of said exterior surface portion of said first bladder member having said first gripping surface coating deposited thereon is positioned on an opposite side of said support structure from said at least twenty inflatable multi-directional channeling structure protrusions extending from said second outwardly directed surface of said second bladder member; and a plurality of tent attachment mechanisms in connection with said support structure and securable to a tent in a manner such that a floor member provided in said tent is positioned over said section of said exterior surface portion of said first bladder member having said first gripping surface coating deposited thereon.

2. The tent flooring system of claim 1, wherein:

said first and second bladder members share at least one common wall.

3. The tent flooring system of claim 2 wherein:

said inflatable multi-directional channeling structure protrusions are substantially cylindrical in shape and are about one and one-half (1½") inches in length.

4. The tent flooring system of claim 3 wherein:

a gap of about one-half (½") inch is provided between each of said inflatable multi-directional channeling structure protrusions.

5. The tent flooring system of claim 2 wherein:

a gap of about one-half (½") inch is provided between each of said inflatable multi-directional channeling structure protrusions.

6. The tent flooring system of claim 1, wherein:

said tent attachment mechanisms include snap fastener assemblies.

7. The tent flooring system of claim 6 wherein:

said inflatable multi-directional channeling structure protrusions are substantially cylindrical in shape and are about one and one-half (1½") inches in length.

8. The tent flooring system of claim 7 wherein:

a gap of about one-half (½") inch is provided between each of said inflatable multi-directional channeling structure protrusions.

9. The tent flooring system of claim 6 wherein:

a gap of about one-half (½") inch is provided between each of said inflatable multi-directional channeling structure protrusions.

10. The tent flooring system of claim 1 wherein:

said gripping surface coating is a rayon flocking material.

11. The tent flooring system of claim 10 wherein:

said inflatable multi-directional channeling structure protrusions are substantially cylindrical in shape and are about one and one-half (1½") inches in length.

12. The tent flooring system of claim 11 wherein:

a gap of about one-half (½") inch is provided between each of said inflatable multi-directional channeling structure protrusions.

13. The tent flooring system of claim 10 wherein:

a gap of about one-half (½") inch is provided between each of said inflatable multi-directional channeling structure protrusions.

14. The tent flooring system of claim 1 wherein:

said inflatable multi-directional channeling structure protrusions are substantially cylindrical in shape and are about one and one-half (1½") inches in length.

15. The tent flooring system of claim 14 wherein:

a gap of about one-half (½") inch is provided between each of said inflatable multi-directional channeling structure protrusions.

16. The tent flooring system of claim 1 wherein:

a gap of about one-half (½") inch is provided between each of said inflatable multi-directional channeling structure protrusions.

17. The tent flooring system of claim 1 wherein:

said valve mechanisms are one-way, duck-bill valves with insertable plugs.

18. The tent flooring system of claim 17 wherein:

said inflatable multi-directional channeling structure protrusions are substantially cylindrical in shape and are about one and one-half (1½") inches in length.

19. The tent flooring system of claim 18 wherein:

a gap of about one-half (½") inch is provided between each of said inflatable multi-directional channeling structure protrusions.

20. The tent flooring system of claim 17 wherein:

a gap of about one-half (½") inch is provided between each of said inflatable multi-directional channeling structure protrusions.

* * * * *